US007199321B1

(12) United States Patent
Huang

(10) Patent No.: US 7,199,321 B1
(45) Date of Patent: Apr. 3, 2007

(54) METAL DOME SWITCH

(75) Inventor: Yu-Cheng Huang, Hsinchu (TW)

(73) Assignee: Altek Corporation, Hsinchu (TW)

( * ) Notice: Subject to any disclaimer, the term of this patent is extended or adjusted under 35 U.S.C. 154(b) by 0 days.

(21) Appl. No.: 11/492,019

(22) Filed: Jul. 25, 2006

(51) Int. Cl.
*H01H 5/18* (2006.01)

(52) U.S. Cl. ..... 200/406; 200/516

(58) Field of Classification Search ..... 200/406, 200/516

See application file for complete search history.

(56) References Cited

U.S. PATENT DOCUMENTS 2,604,316 A * 7/1952 O'Brien et al. ..... 200/406
3,133,170 A * 5/1964 Nanninga ..... 200/406
4,005,293 A * 1/1977 Boulanger ..... 200/516
4,029,916 A * 6/1977 Chu ..... 200/406
4,084,071 A * 4/1978 Smith ..... 200/516
4,385,218 A * 5/1983 Nishida ..... 200/406
6,664,491 B2 * 12/2003 Yanai et al. ..... 200/516
6,951,991 B2 * 10/2005 Asada et al. ..... 200/406
7,075,020 B2 * 7/2006 Asada ..... 200/406

* cited by examiner

*Primary Examiner*—Michael A. Friedhofer
(74) *Attorney, Agent, or Firm*—Rosenberg, Klein & Lee

(57) ABSTRACT

A metal dome switch includes a touch element protruding from a center of the metal dome switch, a connecting element integrally extended from a periphery of the touch element and a mountable surface integrally formed on the touch element. Since the touch element, the connecting element and the mountable surface are integrally formed; the manufacture cost of the metal dome switch can be reduced.

4 Claims, 3 Drawing Sheets

METAL DOME SWITCH

BACKGROUND OF THE INVENTION

1. Field of the Invention

The present invention relates to a metal dome switch, more specifically, to an improved metal dome switch.

2. Description of the Related Art

Taiwanese Utility Model Patent Application Publication No. 420,370 discloses a conventional metal dome switch. As shown in FIG. 1, the conventional metal dome switch 7 comprises a metal spring plate 71, a domed portion 711 formed at the center of the metal spring plate 71, a plurality of wings 712 evenly spaced around the metal spring plate 71, a plurality of winglets 713 each respectively extending from the corresponding wing 712, and a sticker 72 arranged above the metal spring plate 71. The spring plate 71 is mounted on a circuit board 8. A plurality of bumps 81, 82 for connecting a positive electrode and a negative electrode are evenly formed on the circuit board 8. The bump 82 for connecting a negative electrode corresponds to the inner surface of the domed portion 711 of the metal spring plate 71. A membrane 9 provided with a roof portion 91 is arranged above the sticker 72. The roof portion 91 corresponds to the metal spring plate 71 and the membrane 9 is mounted on the circuit board 8, allowing the sticker 72 to be attached between the metal spring plate 71 and the roof portion 91.

Once the roof portion 91 is pressed down, it abuts against the domed portion 711 of the metal spring plate 71, allowing the domed portion 711 to be in contact with the bump 82 of the circuit board 8. The positive electrode of the circuit board 8 is electrically connected with the winglet 713 via the bump 81, allowing the positive electrode to be electrically connected with the negative electrode via the downwardly pressed metal spring plate 71.

However, when the conventional switch 7 is pressed down, the bumps 81, 82 for connecting the positive electrode and the negative electrode are required for the circuit board 8 to be electrically connected with the metal spring plate 71. Such an arrangement needs more parts and causes a higher cost. Moreover, the wing 712 which lacks proper flexibility deforms under the stress from the domed portion 711 and will probably be damaged or even fractured after being used for a long time. Besides, a positioning jig is required when the sticker 72 is manually attached to the metal spring plate 71, increasing the manufacture cost.

Therefore, in view of the above drawbacks of the prior switch, the inventor proposes the present invention to overcome the above problems based on his deliberate researches and related principles.

SUMMARY OF THE INVENTION

The object of the present invention is to provide an integrally formed metal dome switch, which is directly contacting with the circuit board, which is integrally formed of a metal sheet for reducing manufactured element due to reduce the cost. Additionally, the metal dome switch provides an integrally formed mountable surface for reducing manufactured element due to reduce the cost.

To achieve the above object, according to the present invention, a metal dome switch comprises a touch element protruding from a center thereof; a connecting element integrally extended from a periphery of the touch element; and a mountable surface integrally formed on the touch element; whereby the metal dome switch integrally formed of the touch element, the connecting element and the mountable surface.

BRIEF DESCRIPTION OF THE DRAWINGS

The characteristics and the technical content of the present invention will be further understood in view of the detailed description and accompanying drawings, in which.

DETAILED DESCRIPTION OF THE PREFERRED EMBODIMENTS

Figure 1:
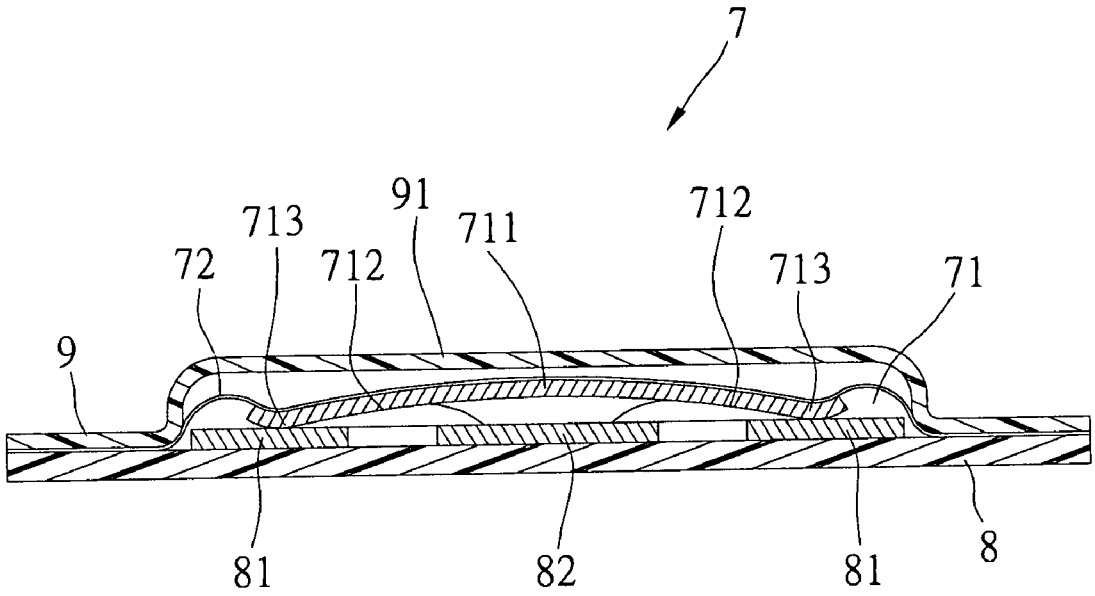
FIG. 1 PRIOR ART
FIG. 1 is a cross-sectional view illustrating a conventional metal dome switch.
Figure 2:
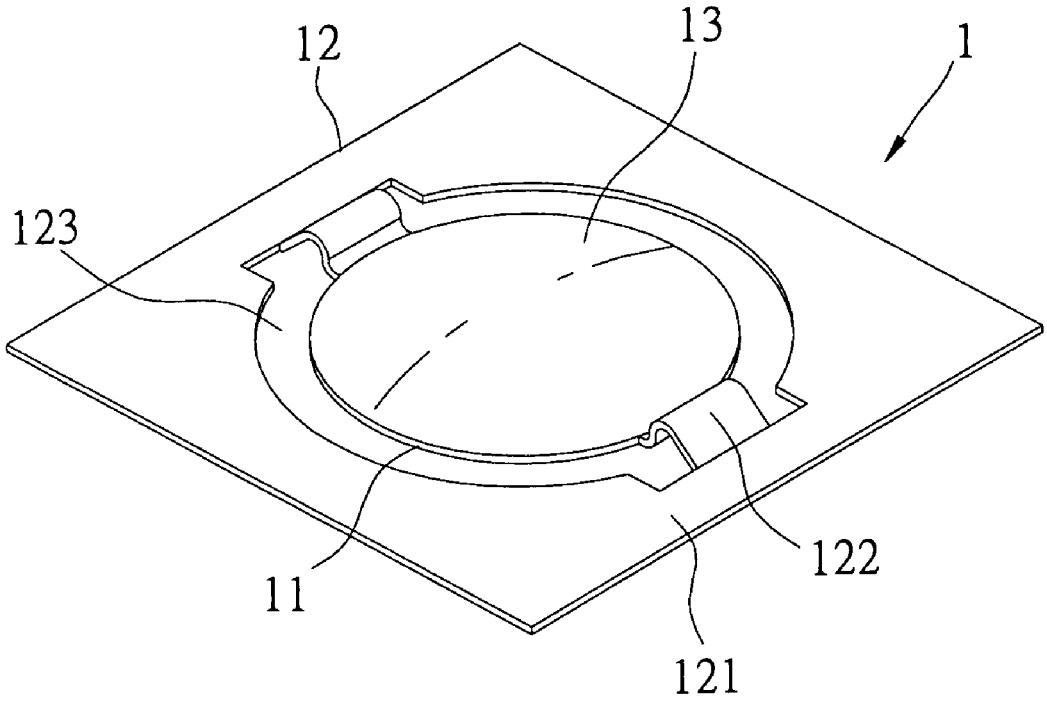
FIG. 2 is a perspective view of a metal dome switch according to a preferred embodiment of the present invention.
Figure 3:
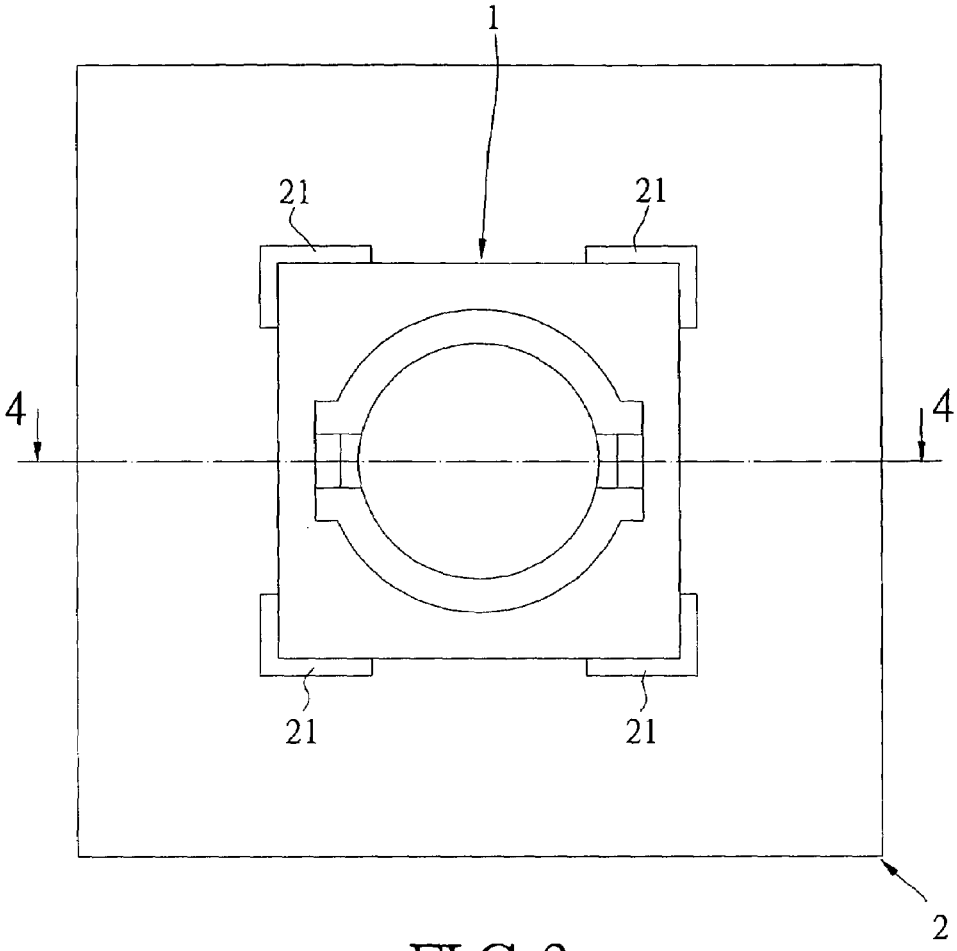
FIG. 3 is a top view of the metal dome switch shown in FIG. 2 mounted on a circuit board.
Figure 4:
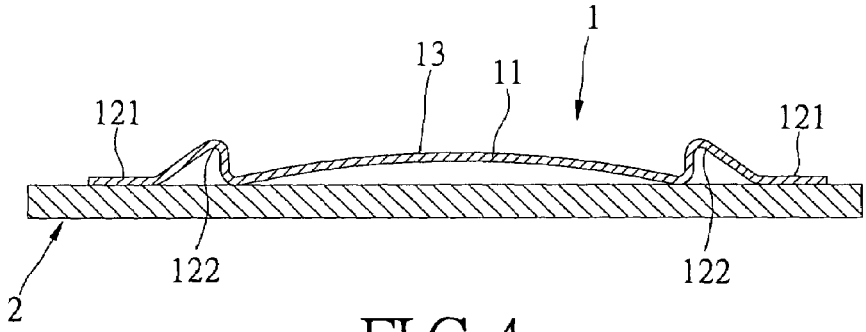
FIG. 4 is a cross-sectional view of the metal dome switch shown in FIG. 2 mounted on a circuit board.

Referring to FIGS. 2 to 4, a metal dome switch according to the present invention is disclosed. The metal dome switch 1 includes a touch element 11, a connecting element 12 and a mountable surface 13. The touch element 11 protrudes from a center of the metal dome switch 1. The touch element 11 is made of a metal sheet and assumes a circular shape. The connecting element 12 is integrally extended from a periphery of the touch element 11. The connecting element 12 includes a fixing portion 121 and a pair of flexible portions 122 such as a pair of flexible arms. The flexible portions 122 is formed by bending upwardly two sides of a metal sheet, and then bending the both sides of the bent metal sheet downwardly. One end of the flexible portions 122 each is connected with the periphery of the touch element 11 and another end is connected with the fixing portion 121. The fixing portion 121 is substantially a square metal sheet. The touch element 11 has a slit 123 at a center thereof. More specifically, the touch element 11 and the flexible portions 122 are separated from the fixing portion 121 by the slit 123. A mountable surface 13 is provided on the touch element 11. In this embodiment, the touch element 11, the connecting elements 12 and the mountable surface 13 are integrally formed. In other words, the metal dome switch 1 is a single piece element.

Four positioning bumps 21 provided around an anode (not shown) mounted on a circuit board 2. Each of positioning bumps 21 has an L-shape and respectively formed at each corner of the square periphery of the fixing portion 121, forming a square pattern. Each corner of the fixing portion 121 abuts against the corresponding positioning bump 21, and thus the fixing portion 121 aligns with the anode on the circuit board 2 and is connected with the anode. In this way, the metal dome switch 1 is directly mounted on the circuit board 2 with the aid of the fixing portion 12.

Once the touch element 11 is pressed down, it will be in direct contact with a cathode (not shown) mounted on the circuit board 2. Since the circuit board 2 is in contact with the touch element 11 and fixing portion 121, the anode and cathode on the circuit board are electrically connected. Additionally, when the flexible portions 122 are pushed by the touch element 11, they will flexibly deform to prevent the connecting element 12 from being damaged.

The metal dome switch 1 is in direct contact with the circuit board 2 without conventional bumps for connecting with the anode and cathode, and therefore the manufacturing process can be simplified and the cost can be reduced. Furthermore, the mountable surface 13 is formed by punching right on the surface of the touch element 11 and such a mountable surface is similar with a conventional sticker attached on the conventional spring plate. Therefore, the manufacture cost can be reduced since there is no need to produce the sticker and attach it on the spring plate any more. Meanwhile, the connecting element 12 is flexibly mounted on the circuit board 2, and thus it can effectively avoid the fracture of the metal dome switch when the metal dome switch is pressed down. Additionally, due to the positioning bump 21 mounted on the circuit board 2, the metal dome switch 1 can be readily mounted on the circuit board 2.

Although the present invention has been described with reference to the aforementioned preferred embodiment, it will be understood that the invention is not limited to the details thereof. Various equivalent variations and modifications can still occur by those skilled in this art in view of the teachings of the present invention. Thus, all such variations and equivalent modifications are also included within the scope of the invention as defined in the appended claims.

What is claimed is:

1. A metal dome switch for use with a circuit board comprising:

a touch element having an integrally formed surface protruding from a center thereof; and a connecting element integrally extended from a periphery of the touch element, said connecting element including a fixing portion and at least a pair of flexible portions, each of said flexible portions having a first end coupled to said touch element and a second end coupled to said fixing portion, said fixing portion being directly coupled to a first electrode of the circuit board, said touch element being displaceable to contact a second electrode of the circuit board, wherein the first and second electrodes have opposing polarities;

whereby the metal dome switch is integrally formed of the touch element and the connecting element.

2. The metal dome switch for use with a circuit board as claimed in claim 1, wherein the touch element assumes a circular shape.

3. The metal dome switch for use with a circuit board as claimed in claim 1, wherein the touch element, the connecting element and the mountable surface are made of a metal sheet.

4. The metal dome switch for use with a circuit board as claimed in claim 1, wherein each of the flexible portions is substantially a flexible arm.

* * * * *